US009833111B2

(12) United States Patent
Torres

(10) Patent No.: US 9,833,111 B2
(45) Date of Patent: Dec. 5, 2017

(54) MULTI-PIECE SHOWER WALL SYSTEM AND METHOD OF INSTALLATION

(75) Inventor: Raymond C. Torres, Morena Valley, CA (US)

(73) Assignee: Aquatic Co., Anaheim, CA (US)

( * ) Notice: Subject to any disclaimer, the term of this patent is extended or adjusted under 35 U.S.C. 154(b) by 1459 days.

(21) Appl. No.: 11/787,159

(22) Filed: Apr. 13, 2007

(65) Prior Publication Data

US 2008/0250558 A1 Oct. 16, 2008

(51) Int. Cl.
*A47K 3/30* (2006.01)

(52) U.S. Cl.
CPC ..... *A47K 3/30* (2013.01)

(58) Field of Classification Search
CPC . A47K 3/284; A47K 3/28; A47K 3/30; A47K 3/283; A47K 3/36; A47K 3/40; A47K 3/281
USPC ..... 4/612, 614, 596, 600, 418
See application file for complete search history.

(56) References Cited

U.S. PATENT DOCUMENTS

| | | | | |
|---|---|---|---|---|
| 2,100,568 | A | 11/1937 | Norris | |
| 2,343,201 | A * | 2/1944 | Nilson | 52/264 |
| 2,677,268 | A | 5/1954 | Hobbs | |
| 3,277,617 | A | 10/1966 | McBride | |
| 3,281,172 | A | 10/1966 | Kuehl | |
| 3,564,788 | A | 2/1971 | Moore | |
| 3,605,352 | A * | 9/1971 | Ruggles et al. | 52/35 |
| 3,789,568 | A * | 2/1974 | Mattix | 52/747.1 |
| 3,827,086 | A | 8/1974 | Seymour et al. | |
| 3,833,944 | A * | 9/1974 | Goettl et al. | 52/169.7 |
| 4,384,377 | A | 5/1983 | Calvert et al. | |
| 4,671,026 | A | 6/1987 | Wissinger | |
| 5,662,069 | A * | 9/1997 | Smith | 119/665 |
| 5,671,489 | A | 9/1997 | Salach | |
| 5,778,463 | A | 7/1998 | Teckchandani et al. | |
| 6,023,889 | A * | 2/2000 | Husting et al. | 52/35 |
| 6,691,339 | B1 | 2/2004 | Thomas | |
| 6,698,037 | B2 * | 3/2004 | Lippe | 4/612 |
| 6,817,144 | B1 * | 11/2004 | Tavivian | 52/35 |
| 7,028,349 | B2 | 4/2006 | Helmetsie et al. | |
| 2005/0086736 | A1 * | 4/2005 | Helmetsie et al. | 4/596 |

* cited by examiner

*Primary Examiner* — Chee-Chong Lee
(74) *Attorney, Agent, or Firm* — Bradley Arant Boult Cummings; Phillip E. Walker; Timothy L. Capria

(57) ABSTRACT

A vertical corner joint for joining a first shower wall panel having a J-shaped channel integrally formed on an edge thereof and second shower wall panel having a resilient, elongate wedge member attached to the back side and along an edge thereof. The edge with the wedge is inserted into the channel of the first panel, thus compressing the wedge and forming a tight corner joint or seam. A multi-piece shower enclosure may include one or more such joints. A four-piece enclosure may include a shower base or bathtub, a back wall with channels on both vertical edges, and two side walls, each with an edge with a wedge for insertion into a respective channel. The channel may form a nailing flange. A sealing strip may be included between the front side of the second panel and the short side of the channel.

18 Claims, 4 Drawing Sheets

MULTI-PIECE SHOWER WALL SYSTEM AND METHOD OF INSTALLATION

BACKGROUND OF THE INVENTION

This invention relates generally to a multi-piece shower enclosure system, more particularly to a multi-piece shower wall system with a new panel joining system, and specifically to a new shower wall panel corner joint.

Wall panel systems utilizing waterproof materials are used to cover studs or stud with wallboard subwalls in shower alcoves in order to provide waterproof enclosures for showers and shower/bath combinations. U.S. Pat. No. 5,778,463 is an example of a four-piece tub/shower unit which relies on butt-joints between wall panels held by Christmas tree clips inserted through apertures. U.S. Pat. No. 5,671,489 is an example of a three-piece unit in which two bulky wall pieces are joined in the middle of a wall by a complimentary tongue and groove. U.S. Pat. Nos. 3,564,788, 3,827,086, and 2,100,568 disclose other examples of multi-piece systems with variations in corner joining methods. U.S. Pat. Nos. 4,671,026, 3,281,172, 3,277,617, and 2,677,268 provide examples of various panel joining systems involving additional joinery pieces, moldings, or seals. None of these examples teaches or suggests an integral corner joint, free of holes and fasteners, and not requiring caulk, but still maintaining a positive seal against water intrusion by means of a resilient wedge member.

BRIEF SUMMARY OF THE INVENTION

The present invention is directed to systems and methods which provide a multi-piece tub or shower enclosure system with a water-tight corner joint between adjacent wall panels. The present invention also provides a caulkless water-tight corner joint that is relatively easy to install.

In one embodiment, the invention is directed to a vertical corner joint for joining a first shower wall panel and second shower wall panel. The first panel has an integral, J-shaped channel formed on an edge thereof, with a short side of the channel attached to the edge of the first panel and a long side of the channel also forming a flange. The second panel has a resilient, elongate member attached to the back side and along an edge thereof. The total thickness of the second panel plus the wedge is greater that the width of the channel on the first panel. The second panel edge, with the attached wedge, may be inserted into the channel, thus compressing the wedge and forcing a tight corner seam between the inside of the second panel and the short side of the channel. The seam may optionally be caulked. The elongate member may have a wedge-shaped cross section.

In another embodiment, the corner joint may have a sealing strip between the inside of the second panel and the short side of the channel. The panels may have additional nailing flanges on other edges. The panels may be raised or shaped, having significant overall thickness or standing out from the underlying wall.

In another aspect of the invention, a multi-piece shower enclosure with one or more wall panels adapted to overlap a flange on a base and abut a ledge on the base may include a transverse ridge on at least one of a wall panel and the base, and a complementary valley or groove on the other of the panel and the base, adapted to ensure proper alignment between panel and base during installation.

The invention is also directed to a multi-piece shower or bathing enclosure system having one or more vertical joints as described above joining two or more wall panels and including an optional shower base or bathtub.

The present invention is also directed to a method of installing a multi-piece shower or tub/shower enclosure having one or more vertical joints as described above.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

The accompanying drawings, which are incorporated in and form part of the specification in which like numerals designate like parts, illustrate embodiments of the present invention and together with the description, serve to explain the principles of the invention. In the drawings.

DETAILED DESCRIPTION

Figure 1:
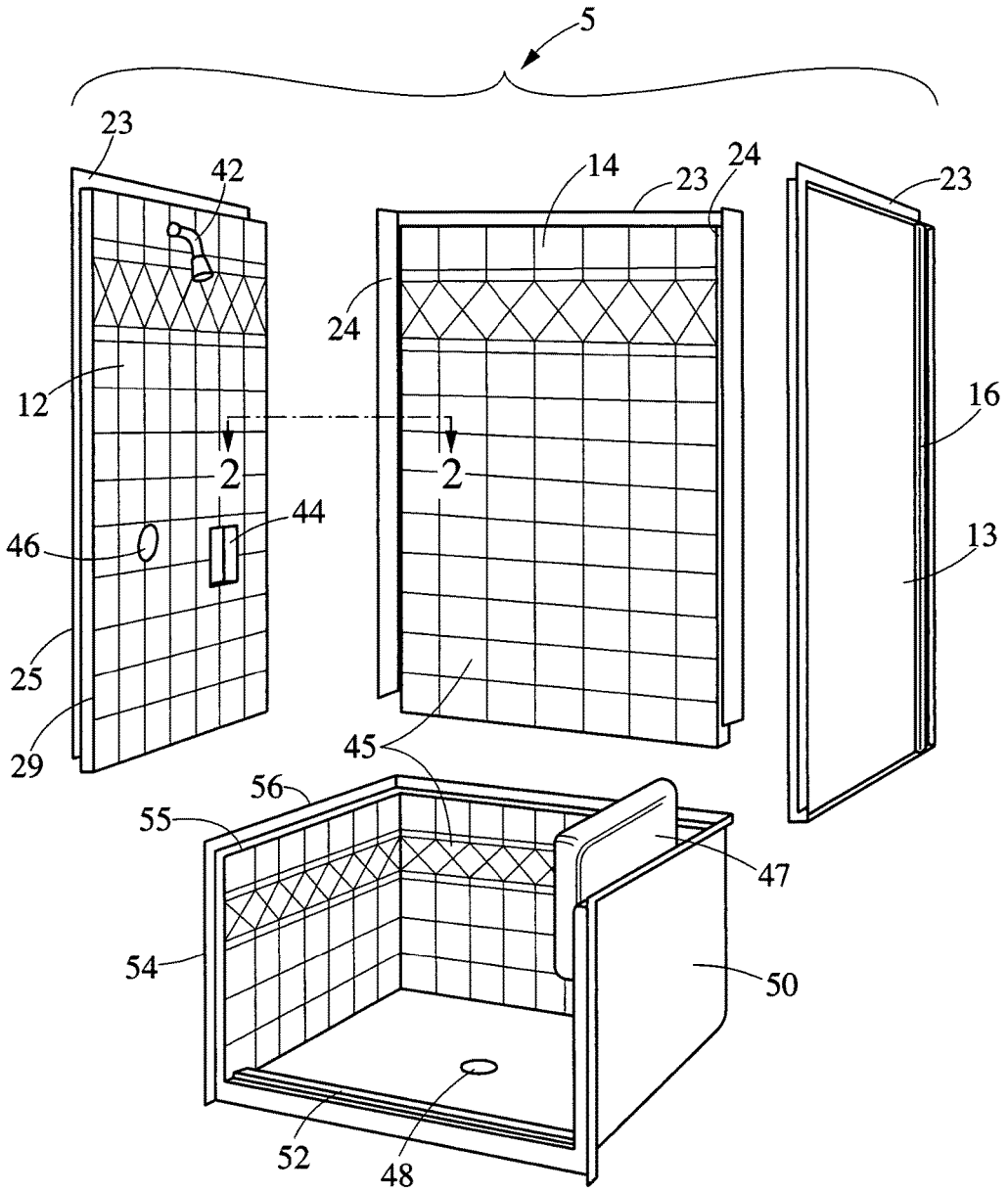
FIG. 1 is an exploded perspective view of an embodiment of the invention.
Figure 2:
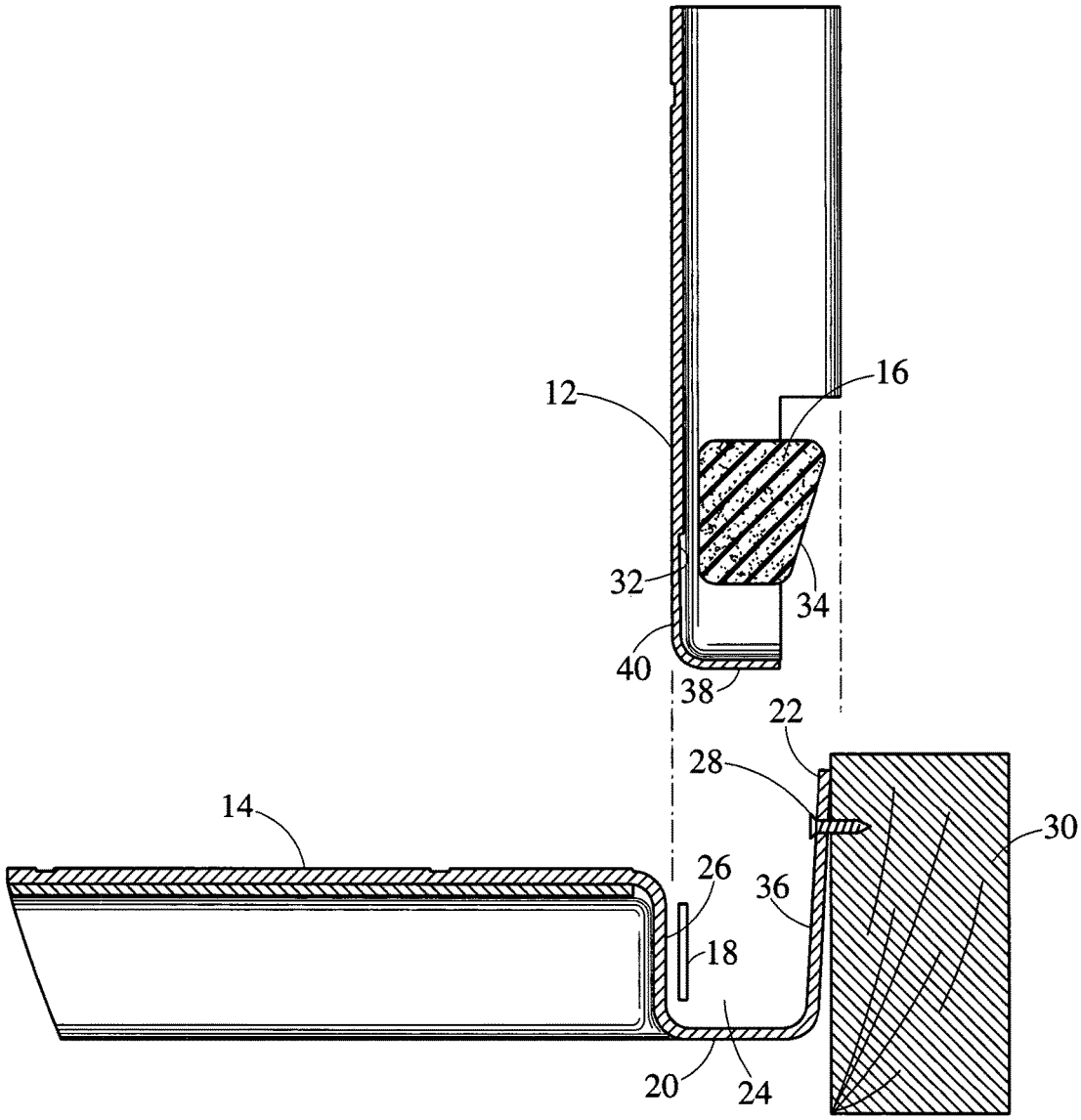
FIG. 2 is an exploded partial cross sectional view of a corner joint of FIG. 1 according to an embodiment of the invention.
Figure 3:
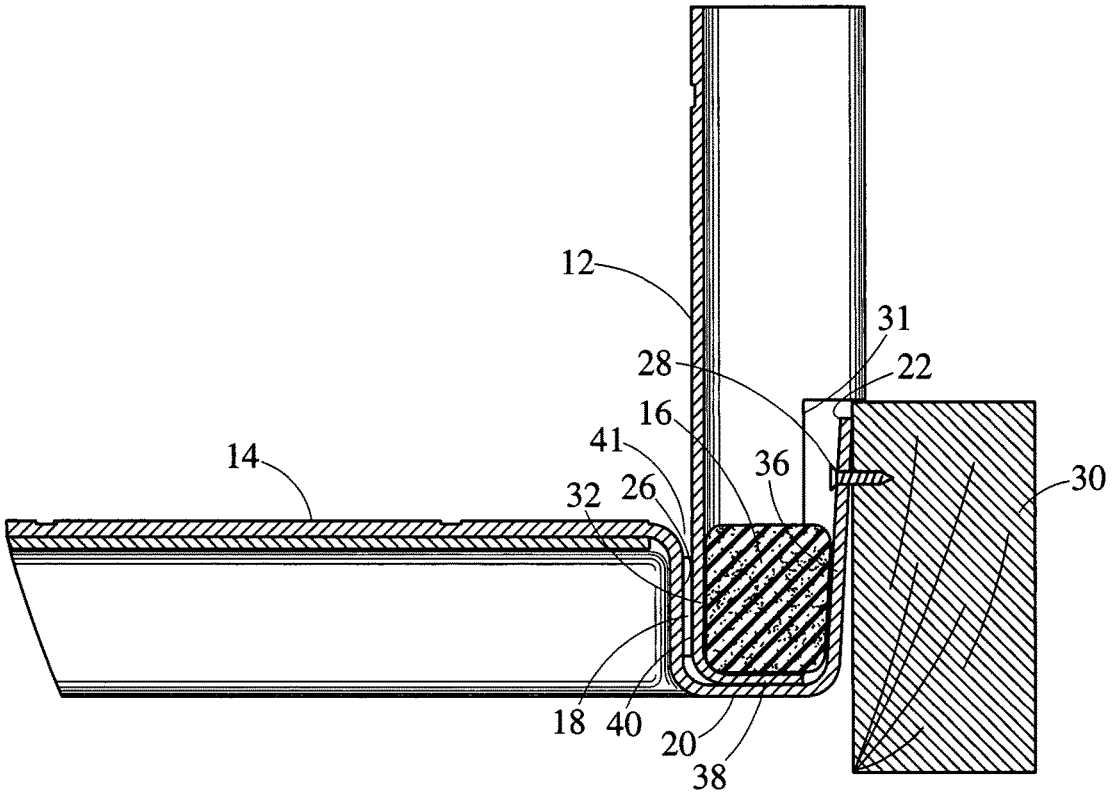
FIG. 3 is an assembled partial cross sectional view of the corner joint of FIG. 2.

FIG. 1 shows multi-piece shower system 5 as an illustrative embodiment of the present invention. The system illustrated is a four-piece unit having shower base 50, left side wall 12, right side wall 13, and back wall 14. The inventive joints are found in the two vertical corners where the side walls meet the back wall. FIG. 2 is a top sectional exploded view of the joint between left side wall 12 and back wall 14. FIG. 3 is an assembled view of the joint of FIG. 2. Herein, the terms "inside", "inner" or "inward" denote a feature on or direction toward the inside of the tub or shower unit, where a bather would be located, including surfaces that would be visible to a bather or installer. In contrast, the terms "outside", "outer" or "outward" denote a direction away from the inside, or away from a bather, including features or surfaces on the outside of the unit which would not be visible to a bather. While a vertical joint is illustrated, it is understood that alternative orientations of panels or joints could be assumed. Specific dimensions and other physical characteristics relating to embodiments disclosed herein are not to be considered limiting unless the claims expressly state otherwise.

Referring to FIG. 2 and FIG. 3, the features and operation of the inventive joint may be described. The mating vertical edges of adjacent walls contain the essential features of the joint. One edge of back wall 14 is shaped in the form of J-shaped channel 20. Channel 20 opens inwardly, with the short leg of the J projecting outward from and approximately perpendicular to the edge of wall 14 and forming inner channel surface 26, and with the long leg of the J projecting inward and approximately perpendicular to the edge of wall 14, thus forming nailing flange 22 with wider, inner, channel, side surface 36 located opposite of narrower, inner, channel, side surface 26. Thus, J-shaped channel 20 defines space 24 for accepting the edge of side wall 12.

The mating edge of side wall 12 may be shaped or flat. Lip 38 on the edge of wall 12 illustrates a shaped edge. Resilient, elongate member or wedge 16 is positioned on outside surface 32 of wall 12 parallel to the edge. The length of wedge 16 is about the same as the length of the edge of the wall. Wedge 16 is an elongated shape of approximately uniform cross section. Wedge 16 may have any cross-sectional shape desired, as long as it is adapted to function as described below. The wedge may have an inclined or angular surface or be wedge-shaped. If wedge-shaped, as illustrated in FIG. 2, wedge 16 may be oriented so the narrowest section is closest the edge of the wall and the thickest section is more remote from the edge of the wall. The wedge may be sized so the narrowest section is thinner than the width of channel 20 and the thickest section is thicker than the width of channel 20. Angular side 34 of wedge 16 may face outward, away from wall 12. When wall 12 is forced into channel 20, the inside surface of the edge of the wall is pressed against channel side surface 26, and angular side 34 of wedge 16 is pressed against other channel side surface 36, thus compressing the wedge and forming a tight joint or seam at corner seam 41. If the edge of wall 12 is shaped, for example like lip 38, the shape dimension should be less than the thickness of wedge 16 to avoid interference with channel 20 and to permit wedge 16 to contact channel surface 36. In other words, the thickest section of the wedge should be thicker than the lip 38 to ensure proper contact and compression of the wedge with the channel side surface. The narrowest section of the wedge may be about as thick or thicker than the lip 38.

Wedge 16 may be of any suitable shape, such as rectangular, round, triangular, or trapezoidal, and/or may have rounded corners. Any suitably resilient wedge material may be used, such as rubber, elastomer, or plastic foam; or solid rubber, elastomer, or plastic; or the like. For example, a suitable wedge may be formed of polystyrene foam. The wedge may be adhered to the wall panel at a factory or provided detached for an installer to apply. Any suitable adhesive or tape or fastening device may be used. Adhesive is preferred over fastening devices requiring holes which could lead to water intrusion. The shape illustrated by wedge 16 of FIG. 2 has a relatively wide and flat surface for maximum contact with surface 32 of side wall 12.

The inner contact line of the corner joint may be referred to as a seam, as shown by seam 41 in FIG. 3. Seam 41, held by the compressive force of wedge 16 as described above, may be sufficiently tight to prevent water intrusion into the joint. Even if water does seep into the joint, compressed wedge 16 may form an even tighter seal against channel surface 36, thus preventing water from escaping the enclosure. For additional protection against water intrusion, sealing strip 18, shown in FIG. 2 and FIG. 3, may be used between channel surface 26 and surface 40 of wall 12. Sealing strip 18 may have adhesive properties. For example, strip 18 may be a double sided adhesive tape applied to surface 26 at the factory, with removable protective film. Such protective film may be removed at time of installation to allow the adhesive tape to bond and seal the joint. The sealing strip may be up to about 1/16-inch thick. It should be understood that seam 41 may be sufficiently tight to be cosmetically or aesthetically acceptable as a finished, caulkless, corner joint. Alternately, the joint, or seam 41 may be caulked or finished to further protect the joint from water intrusion or for aesthetic purposes.

The wall panels illustrated in FIG. 1 are of a raised construction which is well-suited for use with the inventive joint. The panels may thus be shaped with a ledge or approximately perpendicular lip or rim on some, most, or all edges, so the panel stands off or is raised off of the underlying wall or subwall or studs. "Ledge" herein generally refers to a substantially horizontal surface on a top edge of a wall panel, tub, or shower base. "Lip" or "rim" herein generally refers to a vertical surface approximately perpendicular to and on a vertical edge of a wall panel, or to a substantially horizontal surface on a bottom edge of a wall panel. Substantially horizontal surfaces may be horizontal or may have some degree of slope for water drainage or other purpose. The wall panels may furthermore have on some or all edges flanges for attaching the panel to the studs or subwall. The amount the panel is raised, or the overall panel thickness, may advantageously be chosen for compatibility with surrounding wall materials which may overlap the flanges and abut the ledges, lips or raised edges of the panels. For example, the panels may be raised about ½ inch for use with drywall surrounding walls, or ¾ to 1 inch for use with drywall and ceramic tile surrounding walls. Thus, the depth of channel 20 may also be about the same as the amount panel 14 is raised. The width of channel 20 may be about the same as the amount panel 12 is raised. Raising a panel or forming a rim around its edges may also advantageously stiffen the panel and/or have aesthetic purposes. A panel may also have ribs, plates, or other reinforcing structures attached or integrally molded on an outer surface for further stiffening or support. Referring to FIG. 1 for example, back wall 14 and side walls 12 and 13 have top ledge 27 and top flange 23 and front rim 29 and front flange 25. When raised wall panels and flanges are utilized, such as shown in FIG. 1, allowance may be made for snug abutting or overlapping of adjacent panel portions. For example, FIGS. 2 and 3 show cutaway 31 along an edge of side wall panel 12 thus accommodating flange 22 and providing room for wedge 16 to be compressed. Similarly, front flange 25 may be cut back to accommodate flange 54, as shown in FIG. 1.

Figure 4:
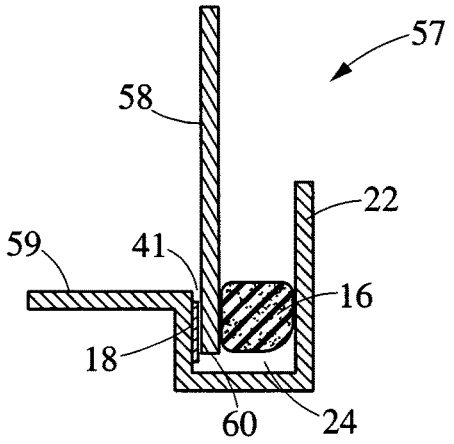
FIG. 4 is a partial cross sectional view of a corner joint according to another embodiment of the invention.

FIG. 4 illustrates vertical corner joint 57, an embodiment of the invention having a flat wall panel. In FIG. 4, edge 60 of flat wall panel 58 and resilient wedge member 16 are press fit into J-shaped channel 24 which is integrally formed on the edge of shaped wall panel 59. Wedge 16 therefore resides under compression between longer leg or side 22 of channel 24 and the back surface of panel 58. Sealing strip 18 may be applied between the front surface of panel 58 and the short leg or side of channel 24. Seam 41 between panels 58 and 59 is water-tight and caulkless. Nevertheless, seam 41 may be caulked if desired for aesthetics.

Though FIG. 1 shows a multi-piece shower enclosure system, the description and principles of the invention apply equally to a bathtub system. The difference would be primarily in the dimensions of the back wall, and in the shape and/or size of the base, namely a bathtub would replace the shower base shown in FIG. 1. Moreover, the invention is applicable to a number of alternate sizes or shapes or styles of bathing enclosures, such as corner units with only two walls, or polygonal units with two or more walls joined at obtuse angles. The wall pieces may be used with an existing base, such as a shower pan or bathtub, for example in a remodeling project. Alternatively, wall pieces may be provided along with a compatible base, such as a shower base or bathtub. Such a compatible base may have for example, interior surfaces raised a like amount to that of the wall panels, and/or with matching ledges and flanges and illustrated in FIG. 1. Referring to FIG. 1, shower base 50 has ledge 55 around its top edge and flange 54 at the front and flange 56 around its top edge. Ledge 55 may be drafted so water drains toward the interior of the enclosure. Other ledges, lips, or rims may also be drafted as needed for manufacturing ease or other purposes.

A multi-piece enclosure system may also have any of a variety of additional accessories or features integral to or attached to or provided in connection with the enclosure. For example, referring to FIG. 1, an enclosure may have drain hole 48 and/or associated drain fittings in shower base 50 or in a tub base. An enclosure system may have soap dish 44, valve 46, fold up seat 47, and/or one or more shelves, ledges, seats or benches, hand rails or grab bars, plumbing fittings or fixtures, shower doors, curtain rods, or the like. Various surfaces of wall panels and/or bases may be textured, lined, or decorated as desired. For example, the surfaces in FIG. 1 exhibit pattern 45 resembling grout lines and ceramic tile.

Figure 5:
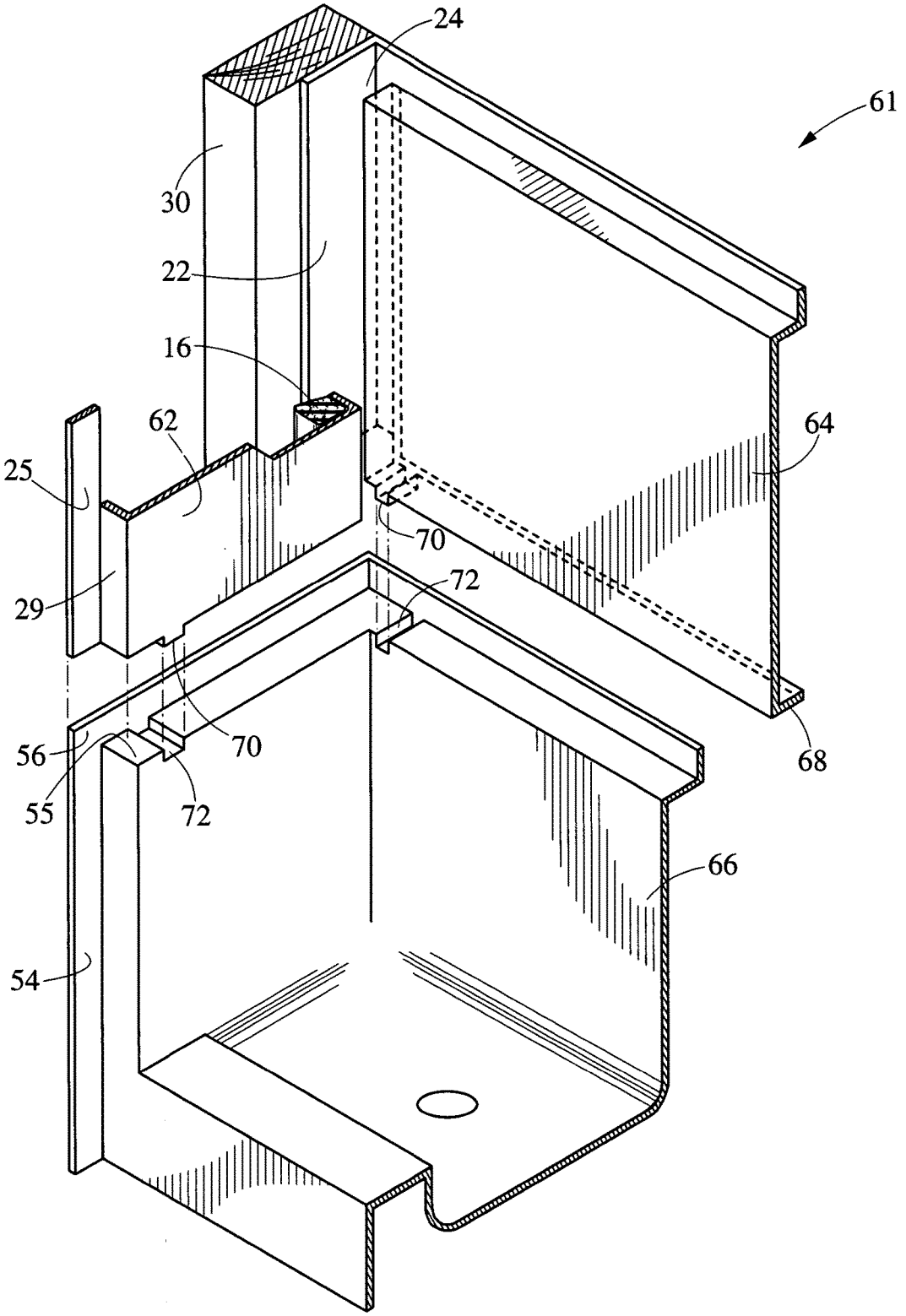
FIG. 5 is an exploded perspective view with parts in section illustrating an aspect of another embodiment of the invention.

FIG. 5 shows another aspect of the invention. FIG. 5 shows multi-piece shower system 61 having side wall 62 mostly cut away, back wall 64 partly cut away, and shower base 66 partly cut away. Back wall 64 may include on a vertical edge thereof J-shaped channel 24 and nailing flange 22 for attaching the wall to stud 30. Panel 64 has shaped edges all around, including bottom rim 68. Rim 68 has at least one transverse ridge 70 or protrusion. Side wall 62 may have vertical flange 25, front rim 29, and has bottom rim 68 with ridge 70. Base 66 may have flanges 54 and 56, and has top ledge 55. Ledge 55 has valleys 72 which are adapted to receive or engage ridges 70 on respective wall panels 62 and 64. These ridges and valleys, when engaged, force the respective wall panels to be in proper alignment with the base, at least in the horizontal direction parallel to the wall. Thus, the front rim and flange of wall panel 62 will be in proper alignment with front rim and flange of base 66. Such alignment may be especially important for a side wall to insure sufficient insertion of the side wall into channel 24 to provide a water-tight seam in the corner. A valley may be drafted toward the inside of the enclosure to aid water runoff. In an alternate embodiment, not shown, a ridge may protrude from the top ledge of the base for engagement with a valley or groove in the bottom rim of a wall panel. In either case, ridge and valley may fit together or engage, snugly or a little loosely, or they may positively engage or snap together.

The construction of the shower wall panels and base may be accomplished by any suitable method and with any suitable material. For example, the panels and/or base may be thermo-formed, compression molded, or transfer molded, for example, utilizing thermoplastic or thermoset composite sheet material. As another example, the pieces may be made by hand or automatic composite lay-up or spray-up methods with various layers including for example a high gloss gel coat. Because the J-channel may be integrally formed with a wall panel, or in-molded on a panel, no extra parts are needed to form the joint.

In use, the inventive joint system provides a multi-piece shower enclosure with a minimum number of pieces that can be easily packaged and installed. The panels are relatively flat and can be stacked and packaged in a relatively small box. Installation can be accomplished completely from the front or inside of the enclosure. The flat panels may be easily handled and maneuvered into position. The flexibility of the joint allows for some dimensional errors in the alcove. Flexibility includes the fact the channels may be spread or opened in width some degree, thus fitting into an alcove that is wider than necessary. Another aspect of flexibility is the ability to accommodate some angular misalignment in the corner. Another aspect of flexibility is the fact the panels may be inserted to a greater or lesser extent as needed to fit the alcove. Thus, the assembly is able to accommodate a variety of common installation inaccuracies.

Installation of a multi-piece shower wall system of the present invention may be accomplished according to the following method. The base is installed in a framed-in alcove as a first step. In a remodel situation where the existing base is to be reused, this step may be considered already accomplished. The base may be leveled, set in mortar, and/or attached to one or more studs with nails, screws, clips, or the like for example through holes drilled in a nailing flange.

A first wall panel having at least one J-shaped channel on a vertical edge is installed in a second step. The wall panel may overlap the nailing flange on the top edge of the base, and/or may abut the top ledge of the base. Silicone or caulk may be applied to the ledge to provide a water-tight horizontal seam. Alternately, a sealing strip like strip 18 in FIG. 2 may be applied between wall panel and base. The resulting horizontal joint or seam may be finished with silicone or caulk, or left caulkless. The wall panel may be fastened to a vertical stud through the nailing flange formed in the longer, inward protruding leg of the J-shaped channel. The wall panel may also have a nailing flange along a top edge for further fastening to studs. Depending on the number of walls and wall panels to be installed, the other vertical edge of the first wall panel may have a nailing flange or a second J-shaped channel which also forms a nailing flange. In either case, the other vertical edge may be attached to another vertical stud through the associated flange.

If at least one set of alignment ridges and valleys are present on respective top ledge and bottom rim of base and wall panel, the step of aligning the ridge and valley may occur during installation of a wall panel, thus enabling proper alignment between wall and base. Installing the wall may include overlapping the top flange with the bottom of the wall so the bottom rim of the wall abuts the ledge.

The third step is to bring a second wall panel into position adjacent the first wall panel and insert an edge having a resilient elongate wedge on its back side into the J-shaped channel of the first wall panel. The wedge may be installed on site, or pre-installed in the factory. Inserting the oversized wedge will compress or press fit the wedge, forming a press fit, tight seam in the corner joint. The joint may include an optional adhesive strip in the J-shaped channel or on the inside of the second wall panel. If so, then any needed strip preparation should be carried out before inserting the second wall panel into the channel. Strip preparation may include removing protective non-adhesive film or paper, and/or applying the strip to the wall panel or the channel side. After insertion of an edge of the second wall panel into the channel, the opposite edge may be fastened to a stud through a nailing flange. The resulting vertical joint may be, but need not be, finished with silicone or caulk. The second wall panel may overlap a nailing flange on the top edge of the base and may abut a top ledge of the base. The resulting horizontal joint may be finished with silicone or caulk.

The above steps would complete the installation of a corner shower unit having only three pieces including base, or the installation of two wall panels onto an existing base. A four-piece unit including base would have a third wall panel with an edge having a resilient wedge on the back side for insertion into a second channel on the first wall panel. Thus, a second vertical corner joint between the third wall panel and the first wall panel would be assembled in the same way as the first joint between the first two wall panels. Likewise a three-wall-panel system could be installed on an existing base. The term "multi-piece" is intended to include all such embodiments and related variations.

The vertical corner seams of the resulting shower enclosure may remain caulkless, or a final step may be to apply silicone or caulk to finish the seams. The invention thus provides a method and system having water-tight corner seams that are cosmetically appealing with or without caulk or silicone.

Although the present invention and its advantages have been described in detail, it should be understood that various changes, substitutions, and alterations can be made herein without departing from the spirit and scope of the invention as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps. The invention disclosed herein may suitably be practiced in the absence of any element that is not specifically disclosed herein.

What is claimed is:

1. A multi-piece bathing enclosure comprising:

a first wall panel and a second wall panel;

said first wall panel consisting of an outer surface and a first vertical edge having a first integrally formed J-shaped channel, said first integrally formed J-shaped channel consisting of a short side wall extending laterally inward in a direction away from said outer surface of said first wall panel, a long side wall opposite said short side wall, and an inner channel wall connecting said short side wall and said long side wall, wherein said short side wall and said long side wall are substantially parallel, wherein said first integrally formed J-shaped channel is adapted to receive a vertical edge of said second wall panel;

said second wall panel comprising a resilient, elongate wedge attached to an outside surface of said second wall panel and along said vertical edge of said second wall panel, wherein said wedge is dimensioned to, when not compressed, have a narrowest cross-section positioned proximate to said vertical edge, said wedge tapering outwardly from the narrowest cross-section to a thickest cross-section positioned distal to said vertical edge;

said vertical edge of said second wall panel inserted into and engaging said first integrally formed J-shaped channel with said resilient, elongate wedge resiliently compressed between said long side wall and said outside surface, thus generating a compressive force pressing an inside surface of said second wall panel toward said short side wall, and thus defining a first vertical corner joint between said first and second wall panels, wherein said first integrally formed J-shaped channel is formed by a molded channel.

2. The multi-piece bathing enclosure of claim 1 wherein said first vertical corner joint further comprises a sealing strip inside said first integrally formed J-shaped channel and residing between said inside surface and said short side wall.

3. The multi-piece bathing enclosure of claim 1 wherein said resilient, elongate wedge has a wedge-shaped cross section when not compressed.

4. The multi-piece bathing enclosure of claim 1 further comprising a shower base or a bathtub and one or more accessories selected from the group consisting of a plumbing fitting or fixture, a seat, a ledge, a shelf, a grab bar, a shower door, and a curtain rod.

5. The multi-piece bathing enclosure of claim 1 further comprising a shower or bathtub base comprising a substantially horizontal ledge adjacent at least one of said first and second wall panels; said ledge having at least one transverse valley and said at least one wall panel having a lower rim with a transverse ridge; wherein said ridge and valley engage when said at least one wall panel and said base are properly aligned.

6. The multi-piece bathing enclosure of claim 1 further comprising a third wall panel having a corresponding resilient, elongate wedge member attached to an outside surface of the third wall panel along a vertical edge thereof; wherein said first wall panel further comprises on a second vertical edge opposite said first vertical edge a second J-shaped channel with a corresponding long side and short side; said vertical edge of said third wall panel inserted into said second J-shaped channel with said corresponding resilient, elongate member resiliently compressed between said corresponding long side and said outside surface of said third wall panel, thus generating a compressive force pressing a corresponding inside surface of said third wall panel toward said corresponding short side, thus defining a second vertical corner joint between said first and third wall panels.

7. The multi-piece bathing enclosure of claim 6 wherein at least one of said vertical corner joints further comprises a sealing strip inside its said first integrally formed J-shaped channel and residing between the said inside surface and the said short side defining said at least one said vertical corner joint.

8. The multi-piece bathing enclosure of claim 6 wherein said resilient, elongate member has a wedge-shaped cross section when not compressed.

9. The multi-piece bathing enclosure of claim 6 further comprising a shower base or a bathtub and one or more accessories selected from the group consisting of a plumbing fitting or fixture, a seat, a ledge, a shelf, a grab bar, a shower door, and a curtain rod.

10. The multi-piece bathing enclosure of claim 6 further comprising a shower or bathtub base comprising a substantially horizontal ledge adjacent at least one of said first, second, and third wall panel; said ledge having at least one transverse valley and said at least one wall panel having a lower rim with a transverse ridge; wherein said ridge and valley engage when said at least one wall panel and said base are properly aligned.

11. A vertical corner joint for joining a first shower wall panel and second shower wall panel of a shower enclosure comprising:

said second shower wall panel;

said first shower wall panel consisting of an outer surface;

a J-shaped channel integrally formed on an edge of said first shower wall panel, a short side wall of the J-shaped channel attached to the edge of the first shower wall panel, said short side wall being approximately perpendicular to said outer surface of said first shower wall panel, a long side wall of the J-shaped channel comprising a nailing flange, said long side wall opposing said short side wall, said long side wall having a width greater than a width of said short side wall, and an inner wall spanning between said short side wall and said long side wall, said inner wall being approximately perpendicular to said short side wall and said long side wall, wherein a width of said J-shaped channel defined by the distance between said short side wall and said long side wall, and wherein said J-shaped channel is positioned inward of said outer surface of said first shower wall panel; and a resilient, elongate wedge member attached to a back side of the second shower wall panel along an edge thereof; so that the total thickness of said second shower wall panel plus said resilient, elongate wedge member when not compressed is greater than the width of said J-shaped channel wherein said first integrally formed J-shaped channel is formed by a molded channel, wherein said resilient, elongate wedge member is dimensioned to, when not compressed, have a narrowest cross-section positioned proximate to said inner wall, said wedge member tapering outwardly from the narrowest cross-section to a thickest cross-section positioned distal to said inner wall.

12. The vertical corner joint of claim 11 wherein said resilient, elongate wedge member is resiliently compressed between said second shower wall panel and said long side when inserted with said edge of said second shower wall panel into said J-shaped channel.

13. The vertical corner joint of claim 11 wherein said resilient, elongate member has a wedge-shaped cross section when not compressed.

14. The vertical corner joint of claim 11 further comprising a sealing strip between said short side and said second shower wall panel.

15. A method of installing a shower enclosure into a framed alcove having at least one corner stud near a vertical corner between two adjacent walls, the method comprising:

a. mounting a first wall panel consisting of an outer surface and a first vertical edge integrally formed in the form of a J-shaped channel including a short side wall extending laterally inward in a direction away from said outer surface of said first wall panel, a long side wall opposite said short side wall, and an inner channel wall connecting said short side wall and said long side wall, wherein said short side wall and said long side wall are substantially parallel, wherein, said first wall panel is oriented so said first vertical edge is in said vertical corner, and wherein said first integrally formed J-shaped channel is formed by a molded channel;

b. fastening said first wall panel to said corner stud from inside the alcove through said long side wall;

c. mounting a second wall panel comprising a second vertical edge and a resilient, elongate wedge member attached to an outside surface of said second wall panel and along said second vertical edge; and d. inserting said second vertical edge into said first J-shaped channel with said elongate wedge member pressed between said long side wall and said outside surface of said second wall panel, thus pressing an inside surface of said second wall panel against said short side wall, and thus defining a first vertical corner joint between said first and second wall panels, wherein said elongate wedge member is dimensioned to, when not compressed, have a narrowest cross-section positioned proximate to said inner channel wall, said wedge member tapering outwardly from the narrowest cross-section to a thickest cross-section positioned distal to said inner channel wall.

16. The method of claim 15, wherein said first wall panel comprises a second J-shaped channel integrally formed on a fourth vertical edge opposite said first vertical edge, and further comprising:

e. mounting a third wall panel with a third vertical edge like said second vertical edge, and inserting said third vertical edge into said second J-shaped channel thus defining a second vertical corner joint between said first and third wall panels.

17. The method of claim 16 further comprising:

f. mounting in said alcove a shower base or bathtub having a top flange along a top ledge; and wherein at least one of a first, second, and third mounting includes the corresponding said first, second or third wall panel overlapping said top flange and abutting said top ledge.

18. The method of claim 17 wherein the top ledge has at least one transverse valley and the corresponding wall panel has a lower rim with a transverse ridge; wherein said transverse ridge and said traverse valley engage when said corresponding wall panel and said base or bathtub are properly aligned.

* * * * *